US008051785B2

(12) United States Patent
Lin

(10) Patent No.: US 8,051,785 B2
(45) Date of Patent: Nov. 8, 2011

(54) COLLAPSIBLE TABLE

(75) Inventor: Chiu-Ting Lin, Taipei County (TW)

(73) Assignee: Gain-Ping Co., Ltd. (TW)

( * ) Notice: Subject to any disclaimer, the term of this patent is extended or adjusted under 35 U.S.C. 154(b) by 340 days.

(21) Appl. No.: 12/322,481

(22) Filed: Feb. 2, 2009

(65) Prior Publication Data

US 2010/0071600 A1 Mar. 25, 2010

(30) Foreign Application Priority Data

Sep. 25, 2008 (TW) ..... 97217305 U

(51) Int. Cl.
*A47B 3/00* (2006.01)

(52) U.S. Cl. ..... 108/115; 108/6

(58) Field of Classification Search ..... 108/132, 108/115, 131, 129, 6, 8; 248/188.6, 188.7, 248/188.1, 439
See application file for complete search history.

(56) References Cited

U.S. PATENT DOCUMENTS 3,796,169 A * 3/1974 Bales et al. ..... 108/116
4,064,815 A * 12/1977 Baum ..... 108/129
4,099,469 A * 7/1978 Sahli ..... 108/115
4,196,675 A * 4/1980 Cook ..... 108/6
5,992,333 A * 11/1999 Lai ..... 108/117
6,019,050 A * 2/2000 Ranta ..... 108/6
6,845,723 B2 * 1/2005 Kottman et al. ..... 108/132
7,703,400 B2 * 4/2010 Mockel ..... 108/115
7,836,833 B2 * 11/2010 Kumazawa ..... 108/115
7,878,128 B2 * 2/2011 Watson et al. ..... 108/132
2008/0295742 A1 * 12/2008 Henriott ..... 108/6
2009/0283020 A1 * 11/2009 Hsu ..... 108/115
2010/0071600 A1 * 3/2010 Lin ..... 108/115

* cited by examiner

*Primary Examiner* — Jose V Chen

(57) ABSTRACT

A collapsible table includes a table board, at least one folding mechanism, and plural table legs. The folding mechanism further includes a central body, at least one rotation lock assembly, and a pair of fastening assemblies mounted on the table legs. The central body is settled between the two fastening assemblies. The rotation lock assembly is arranged between the central body and one of the fastening assemblies, wherein the central body, the rotation lock assembly, and the fastening assembly are mutually coupled and fixed. The rotation lock assembly contains a rotating piece that is rotatable to be positioned at predetermined positions. The rotating piece has one end fixed to a bottom surface of the table board. Thus, all components related to rotating and locking are modularized into and thereby hidden in the folding mechanism to facilitate assembly, disassembly, transportation, and storage of the collapsible table.

16 Claims, 12 Drawing Sheets

B-B section

A-A section

COLLAPSIBLE TABLE

BACKGROUND OF INVENTION

1. Field of the Invention

The present invention relates to a collapsible table and, more particularly, to a collapsible table having a modularized folding mechanism adaptive to table legs of various shapes and structures and capable of hiding therein all driving components for collapsing or expanding the table.

2. Description of the Prior Art

Among various house furnishings, collapsible tables have relatively complex structures and rather high selling prices but nevertheless capture a notable market share due to their advantageous foldability that allows them to be collapsed for easy storage and transportation. Presently, commercially available collapsible tables come in a variety of structures for meeting consumers' various needs. For example, FIG. 1 depicts a conventional and relatively low-priced collapsible table A which is composed essentially of a table board B and a collapsible leg assembly C. While the collapsible table A is advantageous in having a simple structure and allowing rapid collapse, the collapsible leg assembly C is equipped with no mechanism for safely fixing postures thereof. In other words, the collapsible table A even when expanded is in an unstable state, in which the table board B may rotate and thereby folding the collapsible table A if the table board B is pressed at an edge thereof intended for triggering the collapse. Or, if a young child tries to climb up the collapsible table A or impacts the collapsible leg assembly C unintentionally, the collapsible table A may also be rapidly folded, thereby trapping or hitting the child's body. Even worse, the child may be too weak to get rid of the collapsed collapsible leg assembly C and then becomes suffocated. Sadly, such tragedies are reported from time to time, causing broken families and leaving the afflicted parents in indelible grief.

In an attempt to end the tragedies resulting from the aforesaid simple collapsible tables, some collapsible tables are now equipped with safety latches or locking mechanisms for safety purposes, such as those disclosed in U.S. Pat. No. 7,168,372 "Expandable and Collapsible Table", U.S. Pat. No. 6,651,568 "Collapsible Table", U.S. Pat. No. 6,634,304 "Collapsible Table", U.S. Pat. No. 6,026,751 "Collapsible Table", U.S. Pat. No. 5,086,711 "Collapsible Table", and so on.

However, while the collapsible tables of the prior inventions are provided with safety locking mechanisms to ensure postural stability, one thing common among those designs is that all the supporting and driving structures to effectuate locking of the prior art devices are exposed, regardless of the locking mechanisms used. As a result, not only do those collapsible tables have less pleasing appearances (this can be a serious problem when it comes to furniture emphasizing design and style), but also the relative movement between the exposed driving structures may still accidentally injure users trying to collapse or expand the collapsible tables. Besides, theses known collapsible tables have folding mechanisms that must be assembled to the table boards and the table legs respectively through complicated and inconvenient assembling/disassembling processes, which render the collapsible tables unfavorable to fabrication and transportation. Hence, a need exists for an improved collapsible table that remedies all the above-mentioned shortcomings of the known collapsible tables such as inferior appearance, inconvenient assembly/disassembly, inadequate safety, and so on.

SUMMARY OF INVENTION

A primary objective of the present invention is to provide a collapsible table with a modularized folding mechanism, wherein the folding mechanism is easy to assemble/disassemble, thereby facilitating storage and transportation of the collapsible table.

Another objective of the present invention is to provide a collapsible table with a modularized folding mechanism, wherein the folding mechanism is formed as an independent assemblage so as to significantly improve users' safety upon expanding or collapsing the collapsible table.

Another objective of the present invention is to provide a collapsible table with a modularized folding mechanism, wherein the folding mechanism is formed as an independent assemblage enabling a simple, pleasing overall appearance of the collapsible table so as to increase the quality and value of the collapsible table.

Still another objective of the present invention is to provide a collapsible table with a modularized folding mechanism, wherein the folding mechanism is formed as an independent assemblage adaptive to table legs of various shapes so as to allow varied modifications of the collapsible table.

Yet another objective of the present invention is to provide a collapsible table with a folding mechanism, wherein a single said folding mechanism may be used in the collapsible table, or two said folding mechanisms linked through control rods thereof may be employed to flank the collapsible table so that the collapsible table can be easily operated by triggering either of the folding mechanisms.

In order to achieve the aforementioned objectives, the present invention discloses a collapsible table which includes a table board, at least one folding mechanism, and plural table legs. The folding mechanism further includes a central body, at least one rotation lock assembly, and a pair of fastening assemblies mounted on the table legs. The central body is settled between the two fastening assemblies. The rotation lock assembly is arranged between the central body and one of the fastening assemblies, wherein the central body, the rotation lock assembly, and the fastening assembly are mutually coupled and fixed. The rotation lock assembly contains a rotating piece that is rotatable to be positioned at predetermined positions. The rotating piece has one end fixed to a bottom surface of the table board. Thus, all components related to rotating and locking are modularized into and thereby hidden in the folding mechanism to facilitate assembly, disassembly, transportation, and storage of the collapsible table.

BRIEF DESCRIPTION OF THE DRAWINGS

The invention as well as preferred modes of use, further objectives, and advantages thereof will be best understood by reference to the following detailed description of illustrative embodiments when read in conjunction with the accompanying drawings, wherein.

DETAILED DESCRIPTION OF THE PREFERRED EMBODIMENTS

Figure 1:
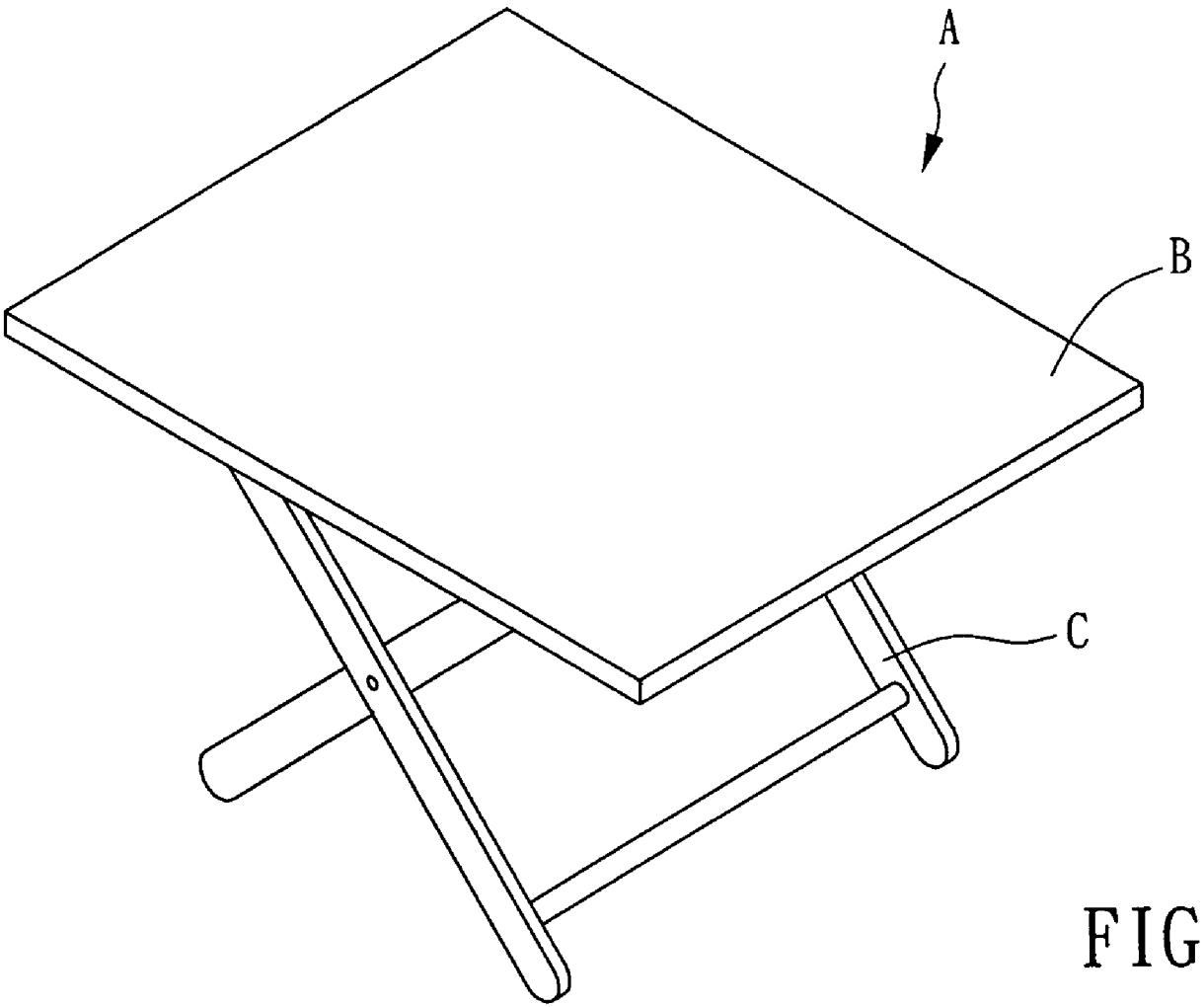
FIG. 1(PRIOR ART)
FIG. 1 is a perspective view of a conventional collapsible table.
Figure 2:
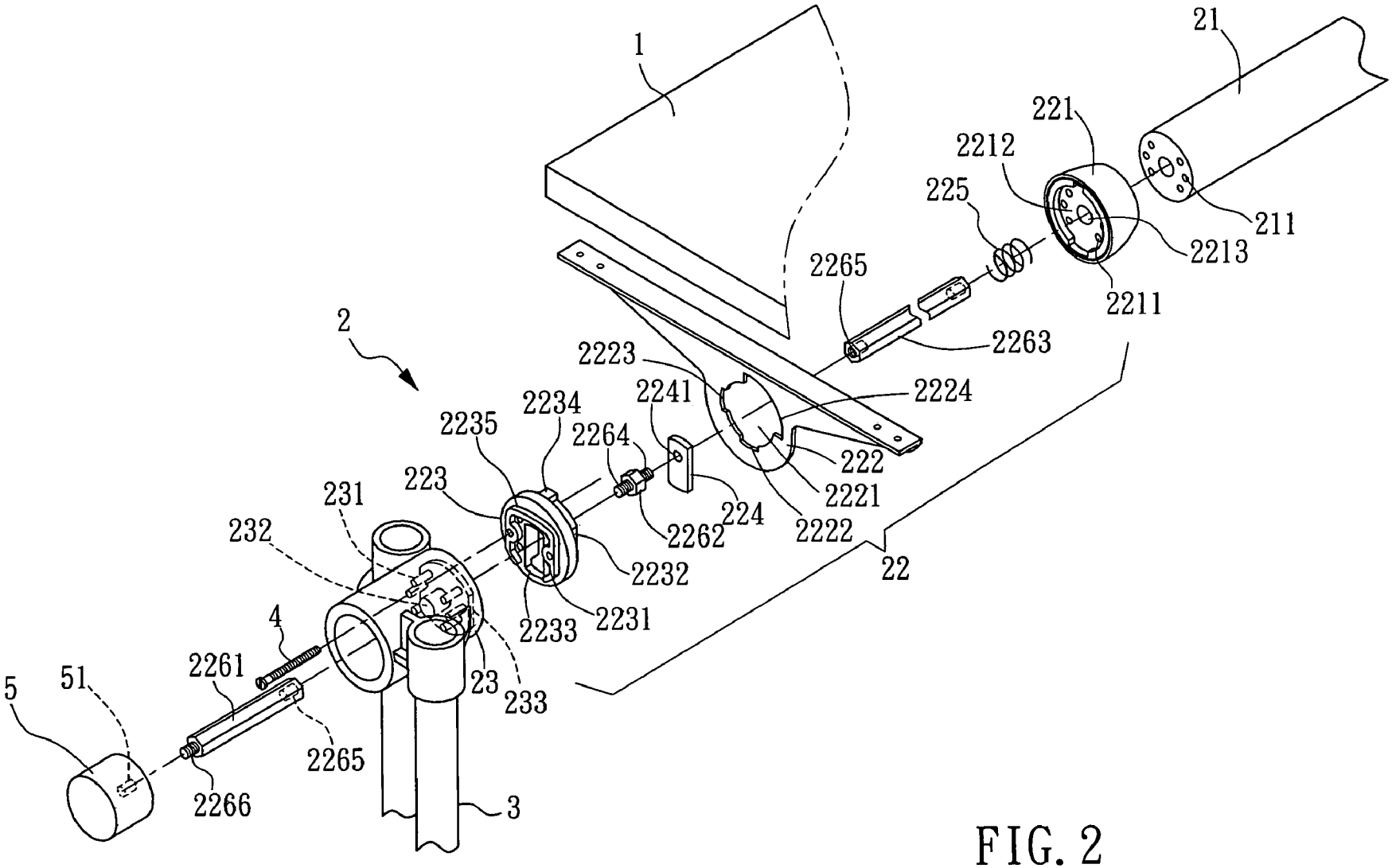
FIG. 2 is a partial exploded view of a collapsible table according to a first embodiment of the present invention.
Figure 3:
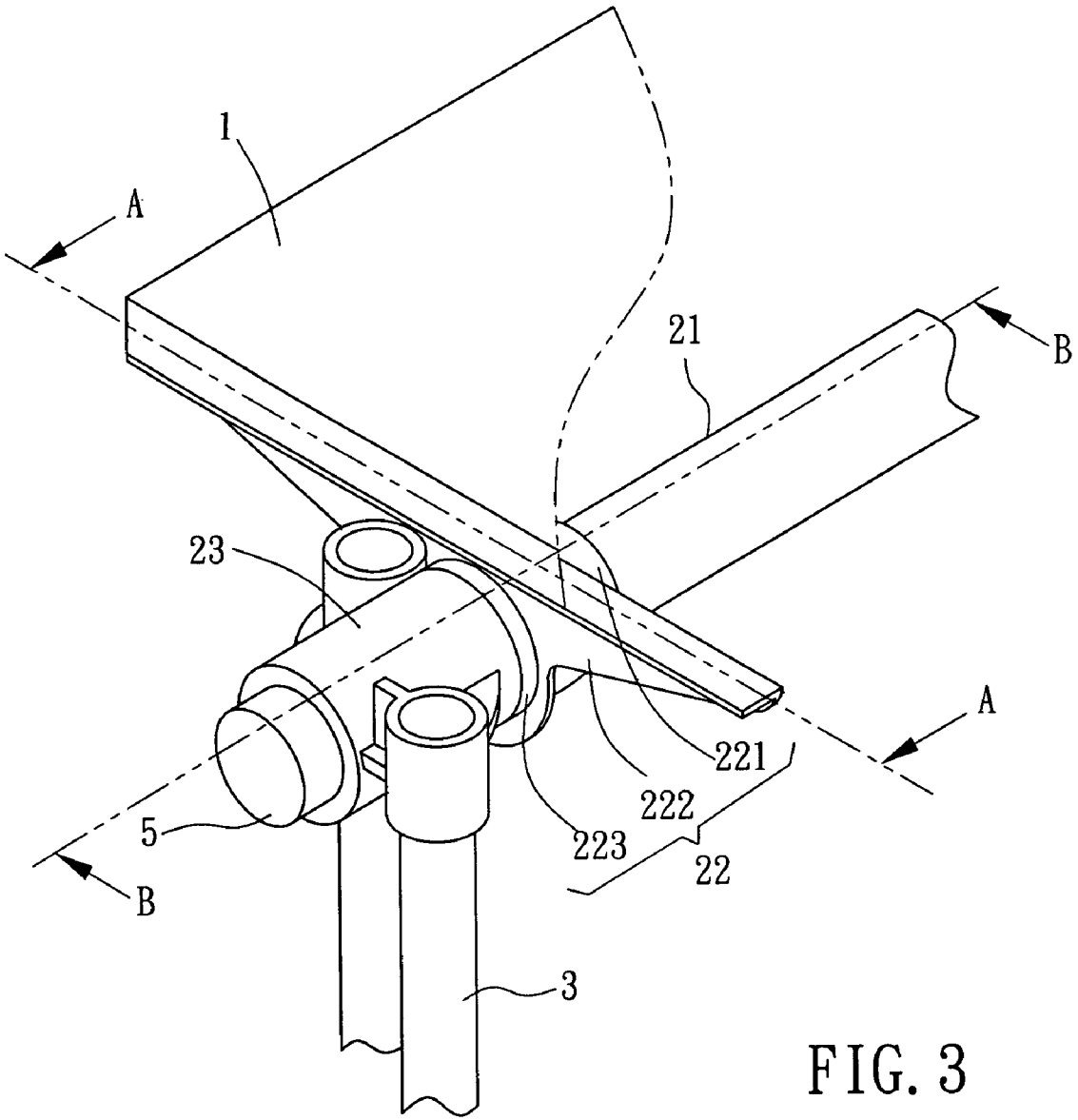
FIG. 3 is a partial assembled view of the collapsible table of FIG. 2.
Figure 7A:
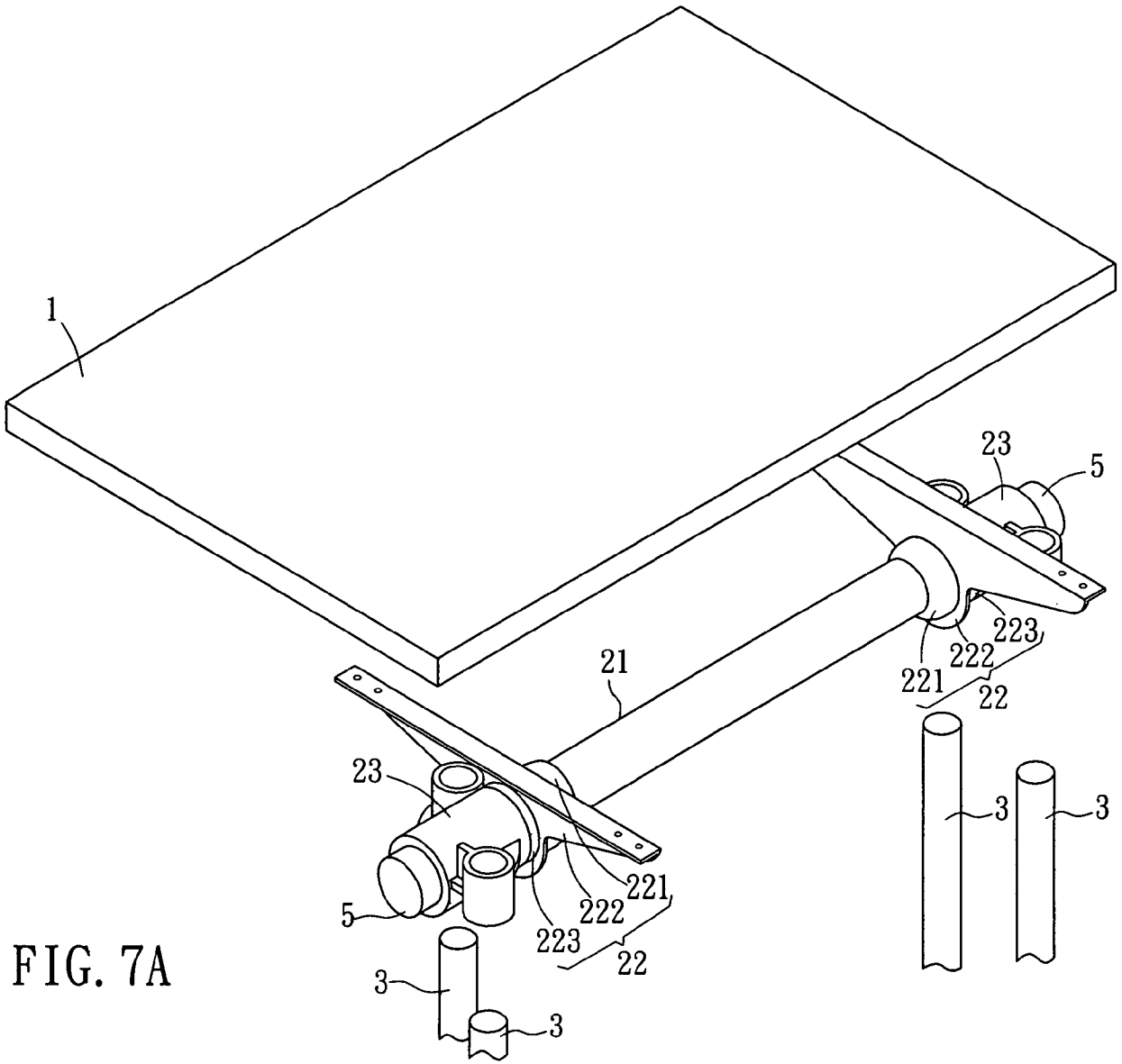
FIG. 7A is a partially exploded view of the collapsible table of FIG. 2.
Figure 7B:
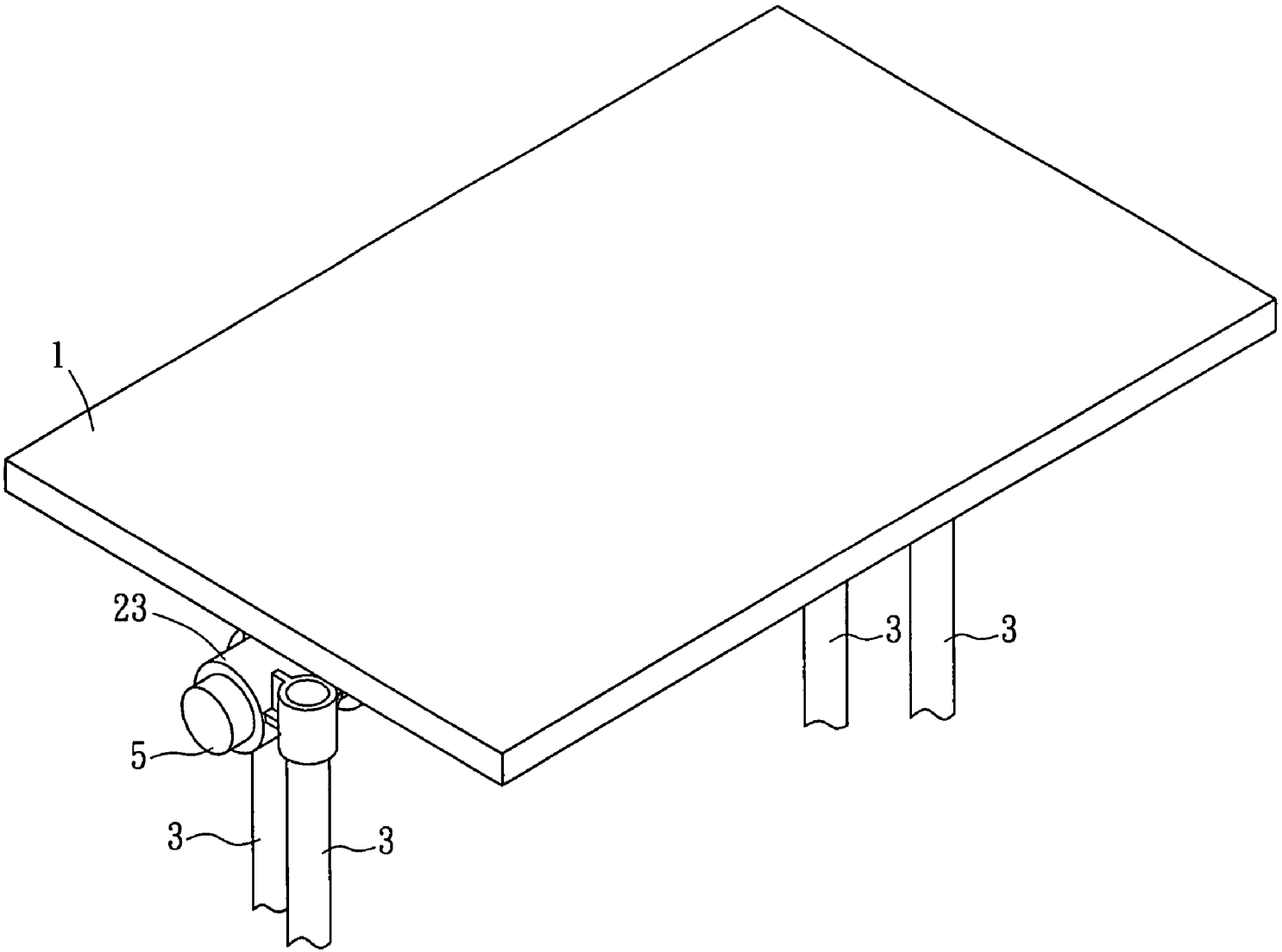
FIG. 7B is a perspective view of the collapsible table of FIG. 2, showing the table board expanded for use.
Figure 7C:
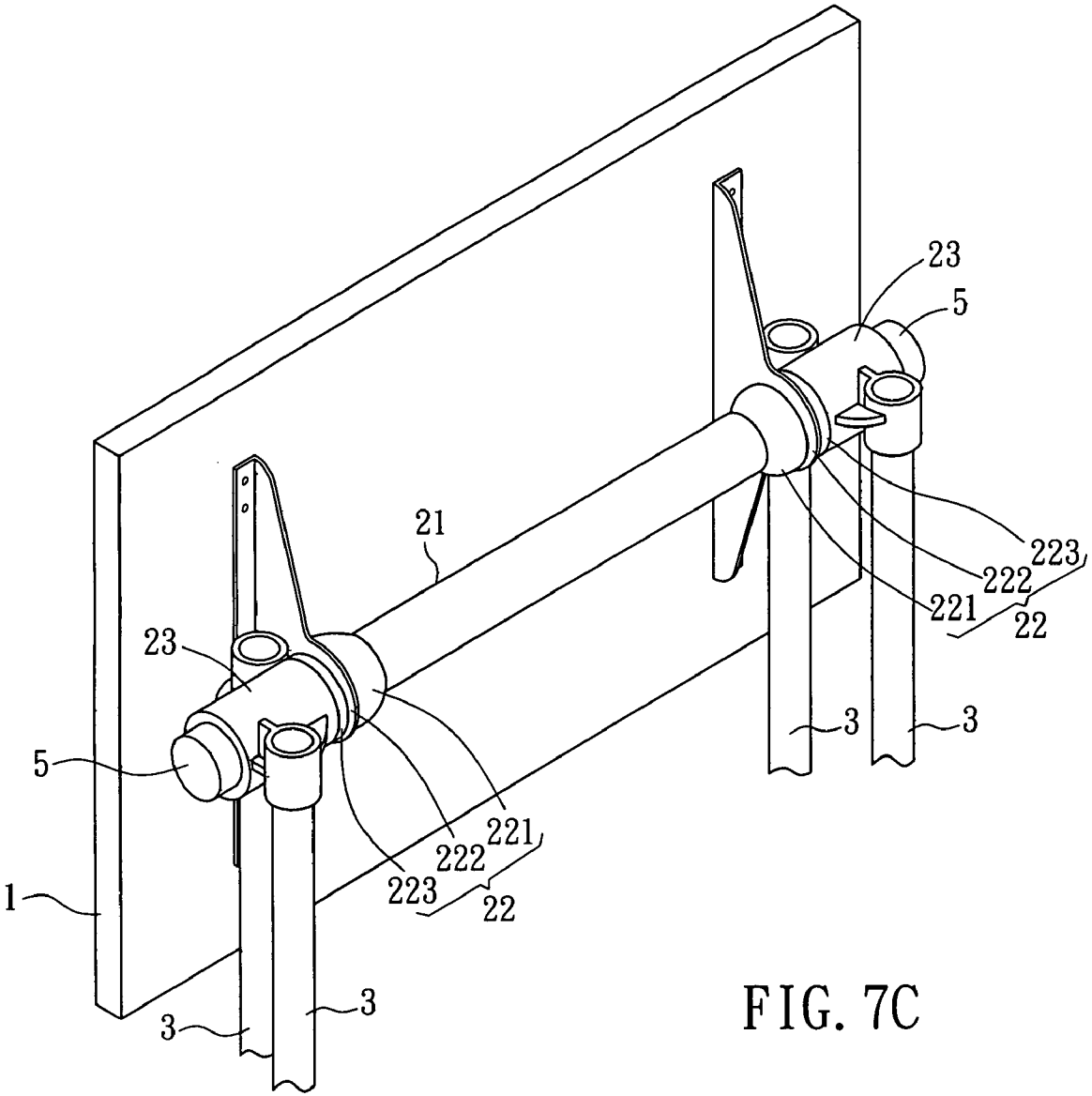
FIG. 7C is another perspective view of the collapsible table of FIG. 2, showing the table board collapsed.

Please refer to FIGS. 2, 3 and 7A for a partial exploded view, a partial assembled view and a partially exploded view of a collapsible table according to a preferred embodiment of the present invention, respectively. The collapsible table primarily includes a table board 1, at least one folding mechanism 2, and plural table legs 3 (as shown in FIG. 7A). The folding mechanism 2 further includes a central body 21, at least one rotation lock assembly 22, and a pair of fastening assemblies 23. The fastening assemblies 23 are configured for being mounted on the table legs 3. The central body 21 is settled between the two fastening assemblies 23. The rotation lock assembly 22 is arranged between the central body 21 and one of the fastening assemblies 23, wherein the central body 21, the rotation lock assembly 22, and the fastening assembly 23 are mutually coupled and fixed. The rotation lock assembly 22 contains a rotating piece 222 that is rotatable to be positioned at predetermined positions. The rotating piece 222 has one end thereof fixed to a bottom surface of the table board 1 so that the table board 1 can be rotated to and fixed at an expanded position (as shown in FIG. 7B) or a collapsed position (as shown in FIG. 7C) as desired, by rotating the rotating piece 222 of the rotation lock assembly 22 in the folding mechanism 2 to one of the predetermined positions.

The present embodiment is now described in detail to further illustrate operation of the folding mechanism 2 of the present invention. Based on the structure disclosed above, the rotation lock assembly 22 further includes a first fastening seat 221, a second fastening seat 223, a locking block 224, a resilient member 225, and a control rod 226 (see FIGS. 9A and 9B), in addition to the rotating piece 222. The first fastening seat 221 and the second fastening seat 223 are provided with plural fastening holes 2211 and 2231, respectively. The rotating piece 222 is settled between the first fastening seat 221 and the second fastening seat 223. The second fastening seat 223, at a side thereof for being coupled with the first fastening seat 221, is formed with a raised portion 2232 that has a circular sectional shape. Meantime, the rotating piece 222 is provided with a through hole 2221 slightly larger than the raised portion 2232 in area. The through hole 2221 is peripherally formed with at least two notches, herein named as a first notch 2222 and a second notch 2223. Besides, the first fastening seat 221 and the second fastening seat 223 at their sides facing each other are formed respectively with cavities 2212 and 2233 which match the locking block 224 in shape. Bottoms of the cavities 2212 and 2233 are formed respectively with through holes 2213 for the control rod 226 to pass through. When assembled together, the first fastening seat 221 and the second fastening seat 223 jointly define an accommodating space for receiving the locking block 224. The cavities 2212 and 2233 have their upper edges matching with an inner edge of the notches 2222 or 2223 of the rotating piece 222 mounted around the raised portion 2232 of the second fastening seat 223, so that the locking block 224 is allowed to move inside the aforesaid accommodating space. The locking block 224 may be fixedly provided on the control rod 226. The resilient member 225 is mounted around the control rod 226 and settled within the cavity 2212 of the first fastening seat 221 while being retained by the locking block 224. The resilient member 225 may be a compression spring. In addition, threaded holes 211 and fastening holes 231 are provided respectively on each of two ends of the central body 21 and the fastening assemblies 23, in positional correspondence to the fastening holes 2211 and 2231 on the first fastening seat 221 and the second fastening seat 223, respectively. Moreover, each of the fastening assemblies 23 may be further provided with a through hole 232 for the control rod 226 to pass through.

According to the previously described structure, assembly of the folding mechanism 2 is carried out by first mounting the resilient member 225 around the control rod 226 and at a side of the locking block 224 where the locking block 224 contacts the first fastening seat 221. Then the control rod 226 has its one end passing through the through hole 2213 at the bottom of the cavity 2212 in the first fastening seat 221, so that two ends of the resilient member 225 come into contact with the bottom of the cavity 2212 and the locking block 224, respectively. Afterward, the rotating piece 222 has its through hole 2221 directly mounted around the raised portion 2232 of the second fastening seat 223. Following that, screws 4 directly pierce from the fastening holes 231 of the fastening assembly 23 through the fastening holes 2231 of the second fastening seat 223 and the fastening holes 2211 of the first fastening seat 221 to couple threadingly with the threaded holes 211 formed on the central body 21, so that the control rod 226 passes through and projects from the through hole 232 formed on the fastening assembly 23, as shown in FIG. 3.

Figure 4B:
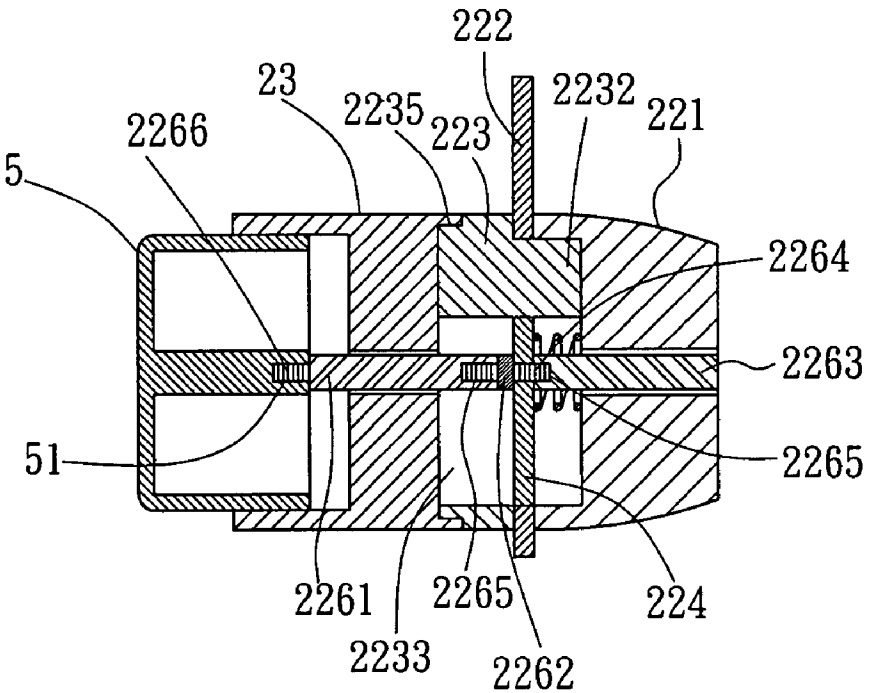
FIG. 4B is a cross-sectional view of the rotation lock assembly taken along line B-B of FIG. 3, showing the table board expanded and locked.
Figure 4A:
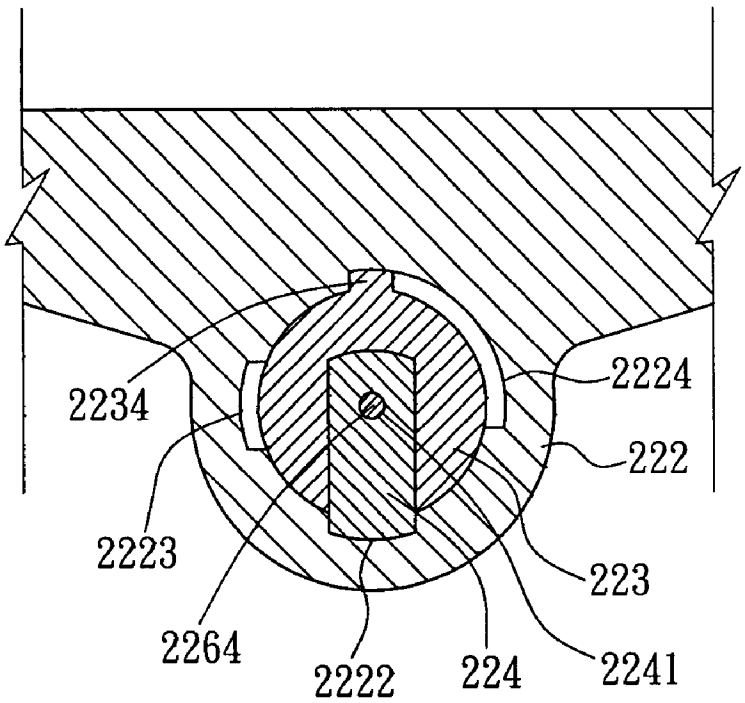
FIG. 4A is a cross-sectional view of a rotation lock assembly of the collapsible table taken along line A-A of FIG. 3, showing a table board expanded and locked.
Figure 5B:
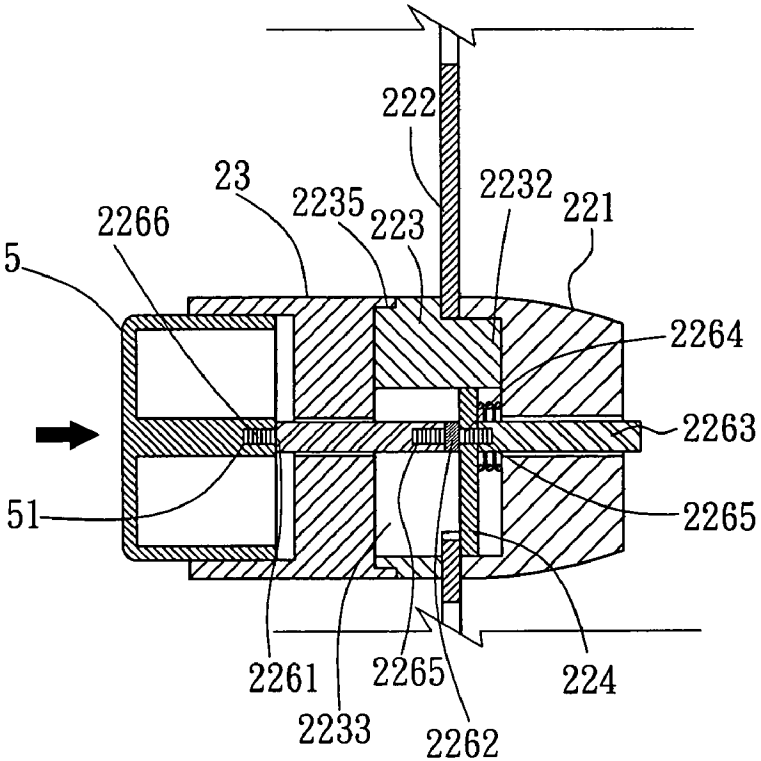
FIG. 5B is another cross-sectional view of the rotation lock assembly taken along line B-B of FIG. 3, showing the table board being free to rotate.
Figure 5A:
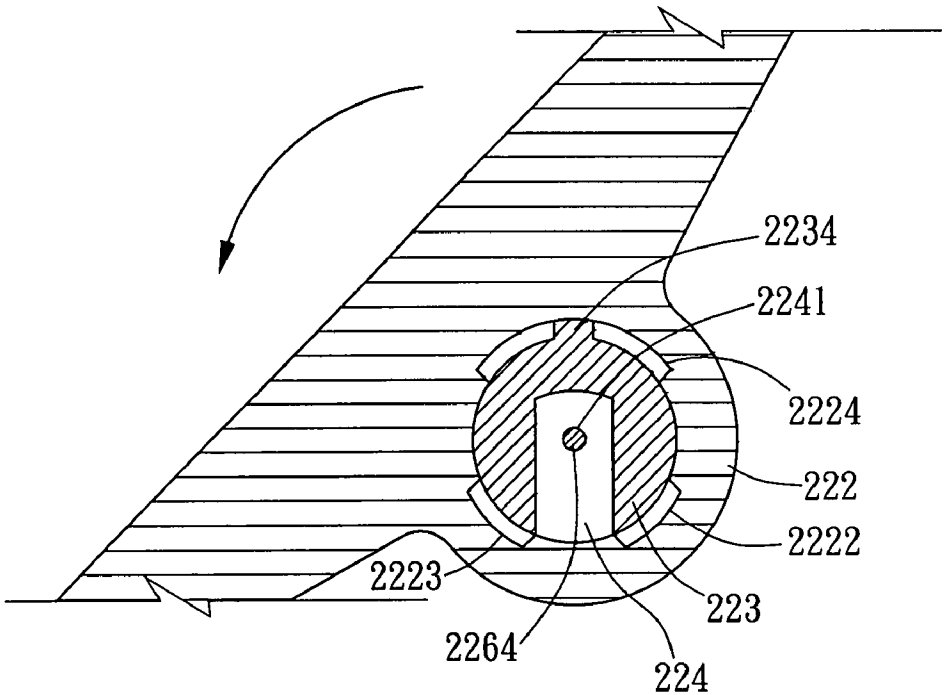
FIG. 5A is another cross-sectional view of the rotation lock assembly taken along line A-A of FIG. 3, showing the table board being free to rotate.
Figure 6B:
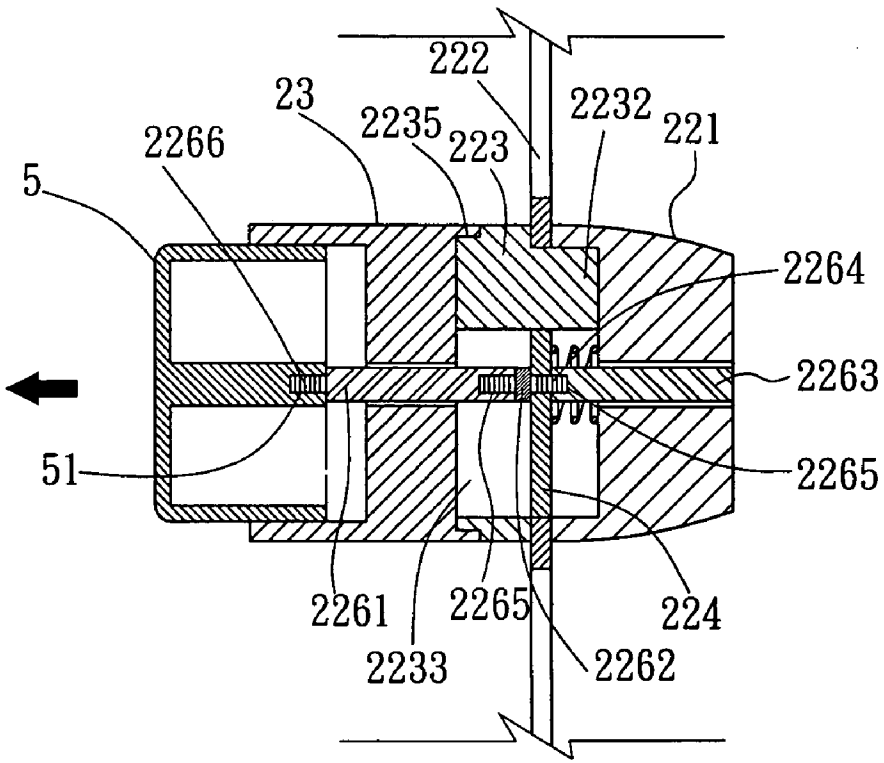
FIG. 6B is another cross-sectional view of the rotation lock assembly taken along line B-B of FIG. 3, showing the table board collapsed and locked.
Figure 6A:
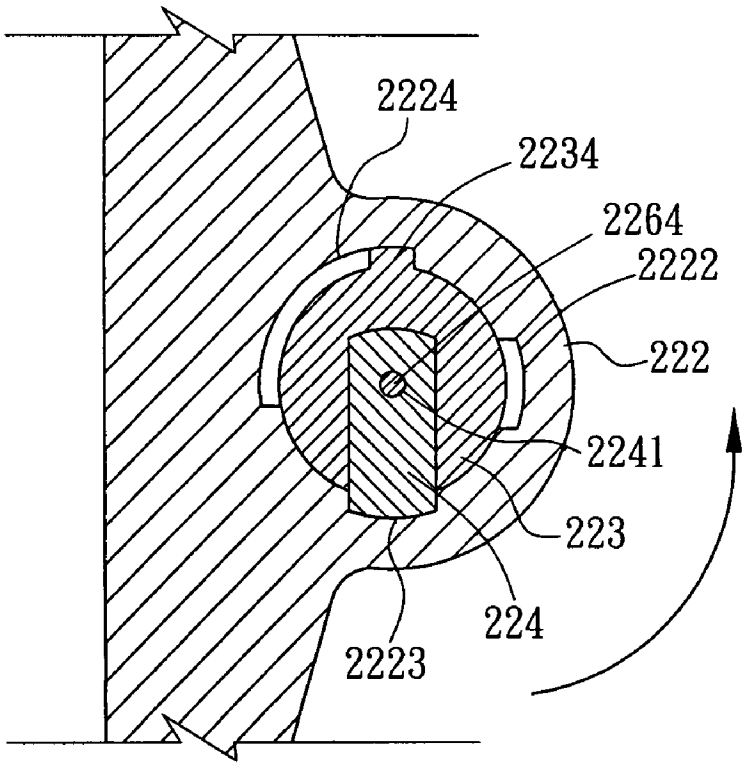
FIG. 6A is another cross-sectional view of the rotation lock assembly taken along line A-A of FIG. 3, showing the table board collapsed and locked.

Reference is now made to FIGS. 4A, 4B, 5A, 5B, 6A, and 6B where operation of the rotation lock assembly 22 of the present invention is illustrated in sectional views. Therein, FIGS. 4A, 5A, and 6A are sectional views taken along line A-A of FIG. 3, while FIGS. 4B, 5B, and 6B are sectional views taken along line B-B of FIG. 3. FIGS. 4A and 4B show the rotation lock assembly 22 locked at a position where the table board 1 is expanded, while FIGS. 5B and 5B show the rotation lock assembly 22 released and free to rotate. According to FIG. 4A, when the disclosed collapsible table is in a normal condition in which the table board 1 is expanded for use, the locking block 224 has its one end coupled with the first notch 2222 of the rotating piece 222 and has the rest of its body settled in the cavity 2233 of the second fastening seat 223. At this time, the locking block 224 serves to prevent the rotating piece 222 from rotation. When it is desired to change the position of the table board 1, a user can press the control rod 226, which projects from the through hole 232 of the fastening assembly 23, from outside the fastening assembly 23 so as to push the control rod 226 and the locking block 224 affixed thereon to move inward and compress the resilient member 225 that is mounted around the control rod 226 and positioned between the locking block 224 and the cavity 2212 of the first fastening seat 221. When the locking block 224 entirely enters the cavity 2212 of the first fastening seat 221 (as shown in FIG. 5B), there is nothing between the rotating piece 222 and the raised portion 2232 of the second fastening seat 223 that prevents the rotating piece 222 from rotating. As a result, the rotating piece 222 is released and free to rotate, and rotation of the rotating piece 222 will drive the table board 1 fixed thereon to rotate in unison. Meanwhile, the resilient member 225 continues providing a resilient restoring force to push the locking block 224 and the control rod 226 back outward. When the rotating piece 222 is rotated to a position where the second notch 2223 of the rotating piece 222 aligns with the cavity 2233 of the second fastening seat 223, the locking block 224 is pushed back into the cavity 2233 of the second fastening seat 223 by the resilient restoring force of the resilient member 225, as shown in FIG. 6A. At this time, since the locking block 224 is coupled with both the cavity 2233 of the second fastening seat 223 and the second notch 2223 of the rotating piece 222, as shown in FIG. 6A, the rotating piece 222 is prevented from rotation, so as to achieve an automatic, staged positioning effect. Now the table board 1 affixed to the rotating piece 222 is locked at a collapsed position.

By such design, the present invention provides an integrated, modularized, and independent folding mechanism 2 which is not only easy to assemble and disassemble, but also eliminates the inconvenience caused by scattered, disassembled components and the risk of failure in reassembly due to lost components. Moreover, since assembly and disassembly of the folding mechanism 2 can be easily done by removing the screws in the rotating piece 222 for connecting the table board 1 and the folding mechanism 2 and detaching the table legs 3 from the fastening assemblies 23 mounted thereon, without disassembling the rotation lock assembly 22, assembly and disassembly of the collapsible table do not require skilled workers but can be accomplished by a general consumer with simple tools (such as a screwdriver). Consequently, the collapsible table is easy to fabricate and convenient to store and transport and allows consumers to reassemble it in a DIY manner so as to remedy the defects of the prior art devices that they cannot be easily assembled/disassembled by general consumers.

Besides, in the present invention, all the components for locking and rotating are hidden in the folding mechanism 2, and thus movements of all these components in the rotational releasing or automatic locking processes are also concealed in the folding mechanism 2. Consequently, not only is the operation of the folding mechanism 2 safer, but also the hidden components and structures are effectively protected from corrosion caused by moisture and impact of external force so that durability of the collapsible table is improved. More importantly, the present invention proposes the aforesaid novel structure where the driving components are completely sheathed to endow the disclosed collapsible table with a neat and simple appearance. Compared with the conventional collapsible tables whose various components are located separately and exposed, the collapsible table of the present invention is a fine piece of furniture with significantly enhanced elegance, quality, and commercial value.

Additionally, in the present invention, all the components for rotating and locking are modularized into the folding mechanism 2, which is not only advantageous in easy assembly and disassembly, but can also adapt to various table legs by simply shaping ends of the fastening assemblies for accommodating the table legs according to shapes of the table leg, so that the present invention is applicable to tables with various types of table boards and table legs. In other words, the present invention has wide applications and is versatile in external design.

In the structure described above, there may be a button 5 further provided at the outer end of the control rod 226. The button 5 is mounted around the outer end of the control rod 226 not only to facilitate pressing so that the control rod 226 can be easily driven, but also provide enhanced esthetics.

Figure 9B:
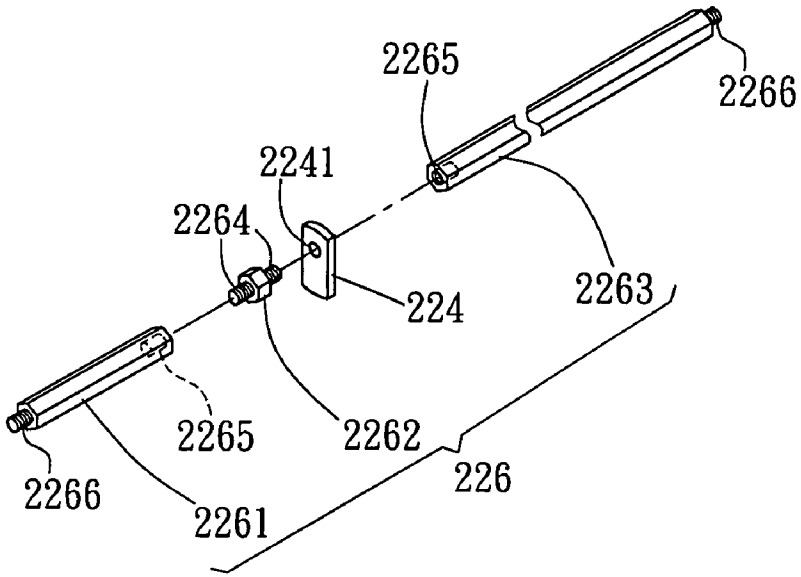
FIG. 9B is a schematic drawing of another embodiment of the control rod according to the present invention.
Figure 9A:
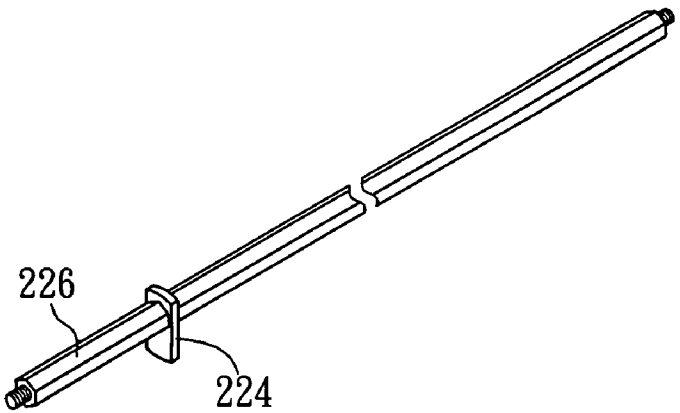
FIG. 9A is a schematic drawing of a control rod according to the present invention.

In the structure described above, the control rod 226 may be formed as an elongate rod having at least one said locking block 224 fixedly attached thereto (as shown in FIG. 9A) so as to be compatible with a structural design for easy assembly/disassembly (as shown in FIG. 7A).

Figure 8A:
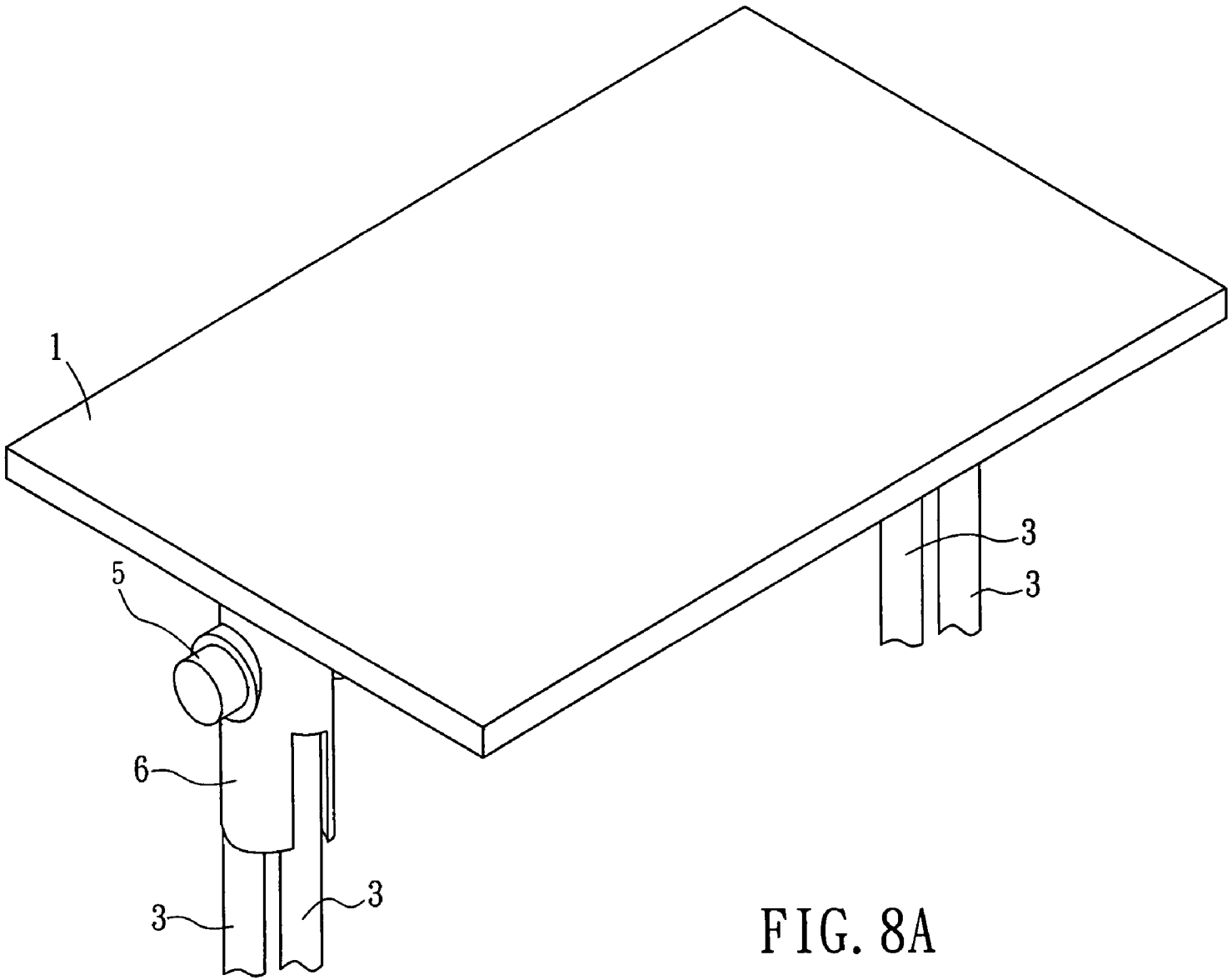
FIG. 8A is a perspective view of a collapsible table according to another embodiment of the present invention.
Figure 8B:
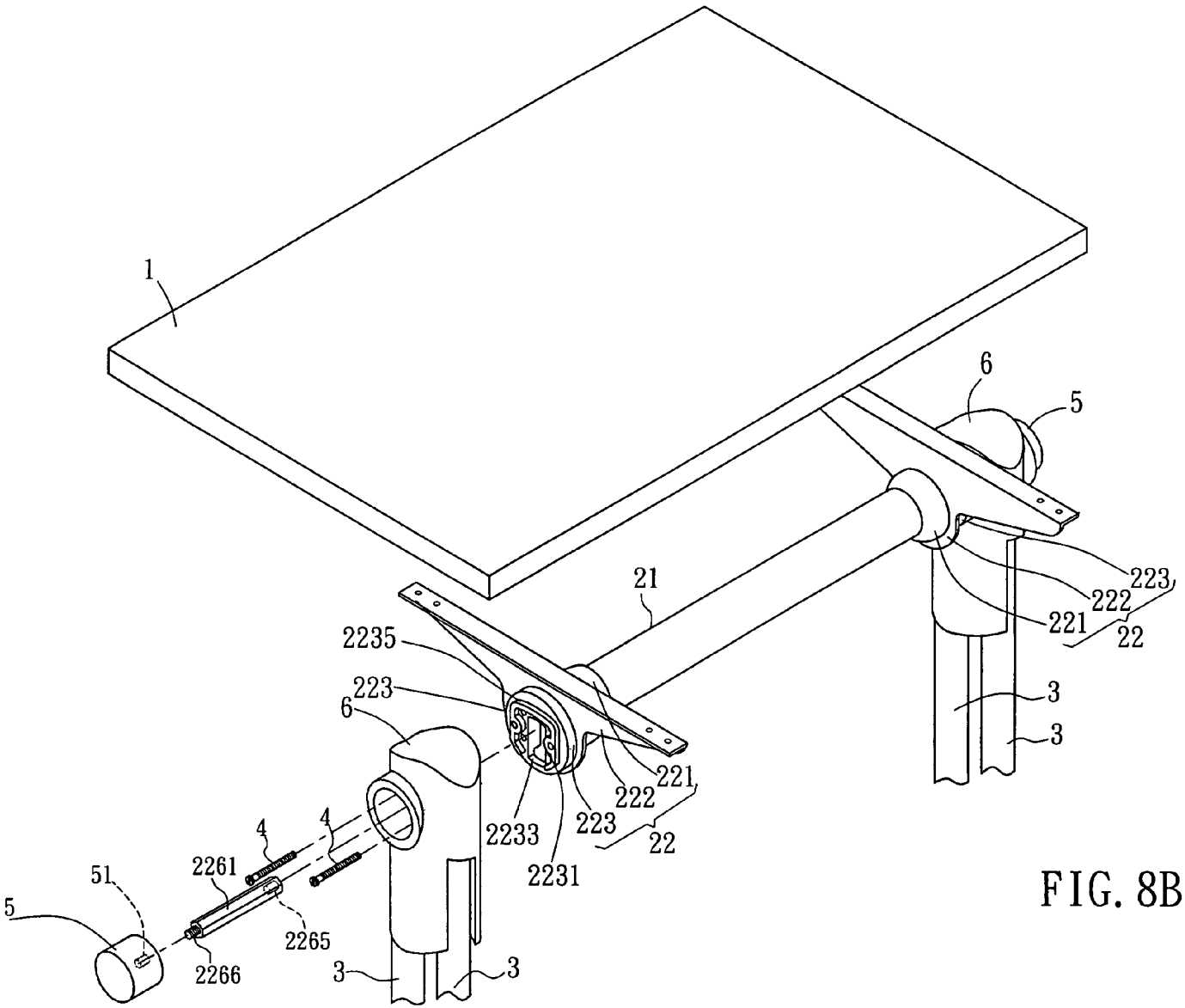
FIG. 8B is an exploded view of the collapsible table of FIG. 8A.

In addition to the design for easy assembly/disassembly shown in FIG. 7A, decorative members 6 may be attached to the table legs 3 for providing enhanced esthetics in appearance (as shown in FIG. 8A). In consideration of the convenience of assembling/disassembling the decorative members 6, another embodiment of the present invention is herein provided (as shown in FIG. 8B). Therein, one of the fastening assemblies 23, the corresponding ones of the table legs 3, and the corresponding one of the decorative members 6 are integrated as one piece that forms the collapsible table together with the other two essential components, that is, the folding mechanism 2 and the table board 1.

According to the aforesaid structure of the present invention, in order to cope with the manner of assembly/disassembly shown in FIG. 8B, the control rod 226 is further defined as being constructed at least from a first control rod 2261, a linking element 2262, and a second control rod 2263 (as shown in FIG. 9B). Therein, the linking element 2262 is disposed between the first control rod 2261 and the second control rod 2263. The linking element 2262 has two ends thereof formed with external threads 2264, respectively. The first control rod 2261 and the second control rod 2263 at their ends adjacent to the linking element 2262 are provided respectively with threaded holes 2265 for being coupled with the external threads 2264 on the linking element 2262. Meantime, the locking block 224 is provided with a through hole 2241 for the external threads 2264 of the linking element 2262 to pass through. The first control rod 2261 has its opposite end formed with an external thread 2266 while the button 5 has its side for being coupled with the first control rod 2261 formed with a threaded hole 51 for mating with the external thread 2266. Therefore, to assemble the control rod 226 with the locking block 224, one of the external threads 2264 of the linking element 2262 is firstly passed through the through hole 2241 on the locking block 224 and coupled with the threaded hole 2265 of the second control rod 2263 so as to fix the locking block 224 on the control rod 226. Then the first control rod 2261 and the linking element 2262 are screwed together. At last, the threaded hole 51 of the button 5 and the external thread 2266 at the outer end of the first control rod 2261 are screwed together.

In the present invention, a single said rotation lock assembly 22 can be used at one side of the collapsible table, or two said rotation lock assemblies 22 can be used at both sides of the collapsible table so that the table board 1 can be released to rotate when the button 5 at either side of the collapsible table is pressed.

Moreover, a bulge 2234 is provided at an edge of the raised portion 2232 of the second fastening seat 223 while the through hole 2221 of the rotating piece 222 is peripherally formed with a third notch 2224, wherein the third notch 2224 has a width equal to a joint width of the first notch 2222, the second notch 2223, and an interval between the first notch 2222 and the second notch 2223. By the bulge 2234 and the third notch 2224, the extent to which and direction in which the rotating piece 222 rotates around the raised portion 2232 of the second fastening seat 223 are restricted.

In the aforementioned structure of the present invention, a positioning block 2235 is further protrudingly provided at one side of the second fastening seat 223 adjacent to the neighboring fastening assembly 23 while the fastening assembly 23 is provided with a positioning recess 233 corresponding in position to the positioning block 2235. Thus, when the second fastening seat 223 is coupled with the corresponding fastening assembly 23, the positioning block 2235 and the positioning recess 233 allow the fastening holes 2231 of the second fastening seat 223 to align rapidly with the fastening holes 231 of the fastening assembly 23, so that the screws 4 can easily pass through the fastening holes 2231 and 231 to fasten the components.

According to the aforesaid structure of the present invention, only one said folding mechanism 2 is enough for the collapsible table to perform the basic rotating function and the automatic locking function. Alternatively, as shown in FIG. 7A, the collapsible table may be provided with two said folding mechanisms 2 and the control rods 226 in the two folding mechanisms 2 are coupled so that when either of the folding mechanisms 2 is operated, the effects of simultaneous release as well as rotation and automatic locking can be achieved.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A collapsible table, comprising a table board, at least one folding mechanism, and a plurality of table legs, wherein the folding mechanism further comprises a central body, at least one rotation lock assembly, and a pair of fastening assemblies; the fastening assemblies being mounted on the table legs; the central body being settled between the two fastening assemblies; the rotation lock assembly being arranged between the central body and one said fastening assembly, in which the central body, the rotation lock assembly, and the fastening assembly are mutually coupled and fixed; the rotation lock assembly containing a rotating piece that is rotatable to be positioned at predetermined positions and has one end fixed to a bottom surface of the table board; the rotation lock assembly further comprising a first fastening seat, a second fastening seat, a locking block, a resilient member, and a control rod, in addition to the rotating piece; the first fastening seat and the second fastening seat being provided with fastening holes, respectively; the rotating piece being settled between the first fastening seat and the second fastening seat; the second fastening seat being formed, at a side thereof for being coupled with the first fastening seat, with a raised portion; the rotating piece being provided with a first through hole which is slightly larger than the raised portion and peripherally formed at least with a first notch and a second notch; the first fastening seat and the second fastening seat being respectively formed, at sides thereof facing each other, with cavities which match the locking block in shape and have bottoms formed respectively with second through holes for the control rod to pass through; the first fastening seat and the second fastening seat when assembled together jointly defining an accommodating space for receiving the locking block; the cavities having upper edges matching with an inner edge of the first or second notch of the rotating piece mounted around the raised portion of the second fastening seat, so that the locking block is allowed to move inside the accommodating space; the locking block being fixed to the control rod; the resilient member being mounted around the control rod and settled within the cavity of the first fastening seat to be retained by the locking block; threaded holes and a fastening hole being provided respectively on each of two ends of the central body and the fastening assemblies in positional correspondence to the fastening holes on the first fastening seat and the second fastening seat; each said fastening assembly being further provided with a third through hole for the control rod to pass through.

2. The collapsible table of claim 1, wherein the raised portion has a circular sectional shape.

3. The collapsible table of claim 1, wherein a button is further mounted around an outer end of the control rod.

4. The collapsible table of claim 3, wherein the control rod comprises a first control rod, a linking element, and a second control rod; the linking element being arranged between the first control rod and the second control rod and having two ends formed with external threads, respectively; the first control rod and the second control rod at their ends adjacent to the linking element being provided respectively with threaded holes for being coupled with the external threads on the linking element, respectively; the locking block being provided with a fourth through hole for the external threads of the linking element to pass through; the first control rod having its opposite end formed with an external thread while the button having a side thereof for being coupled with the first control rod formed with a threaded hole for mating with the external thread of the first control rod.

5. The collapsible table of claim 1, wherein the control rod comprises a first control rod, a linking element, and a second control rod; the linking element being arranged between the first control rod and the second control rod and having two ends formed with external threads, respectively; the first control rod and the second control rod at their ends adjacent to the linking element being provided respectively with threaded holes for being coupled with the external threads on the linking element, respectively; the locking block being provided with a fourth through hole for the external threads of the linking element to pass through.

6. The collapsible table of claim 1, wherein a bulge is provided at an edge of the raised portion of the second fastening seat, and the first through hole of the rotating piece is peripherally formed with a third notch having a width equal to a joint width of the first notch, the second notch, and an interval between the first notch and the second notch.

7. The collapsible table of claim 1, wherein the resilient member is a compression spring.

8. The collapsible table of claim 1, wherein a positioning block is further protrudingly provided at one side of the second fastening seat adjacent to the corresponding fastening assembly, and the corresponding fastening assembly is provided with a positioning recess corresponding in position to the positioning block.

9. The collapsible table of claim 1, wherein two said rotation lock assemblies are used at two sides of the collapsible table, respectively.

10. A collapsible table, comprising:

a table board;

a plurality of table legs;

a pair of fastening assemblies mounted on the table legs, wherein a third through hole is provided at a center of a lateral side of each said fastening assembly, and a plurality of fastening holes are provided around the third through hole;

a central body settled between the two fastening assemblies and having two ends provided respectively with threaded holes corresponding in position to the fastening holes on the fastening assemblies;

a locking block;

at least one first fastening seat positioned between one said fastening assembly and the central body, formed with fastening holes, and having a side adjacent to a second fastening seat and formed with a cavity matching the locking block in shape, wherein a bottom of the cavity is formed with a second through hole for a control rod to pass through;

at least one said second fastening seat positioned between the first fastening seat and the central body, formed with fastening holes, and having a side facing the first fastening seat and formed with a raised portion, the second fastening seat further having a cavity which is formed on the side thereof facing the first fastening seat and matches the locking block in shape so that the first fastening seat and the second fastening seat when assembled together jointly define an accommodating space for receiving the locking block, wherein a bottom of the cavity is formed with another second through hole for the control rod to pass through;

at least one rotating piece settled between the first fastening seat and the second fastening seat and having a first through hole slightly larger than the raised portion at the side of the second fastening seat, wherein said another second through hole is peripherally formed at least with a first notch and a second notch each having a depth allowing the locking block to pass therethrough, in which one end of the rotating piece is fixed to a bottom surface of the table board;

the control rod having the locking block fixedly attached thereto and having two ends that pass through the third through holes on one said fastening assembly, the first fastening seat, and the second fastening seat; and at least one resilient member mounted around the control rod and settled within the cavity of the first fastening seat to be retained by the locking block.

11. The collapsible table of claim 10, wherein the raised portion has a circular sectional shape.

12. The collapsible table of claim 10, wherein a button is further mounted around an outer end of the control rod.

13. The collapsible table of claim 12, wherein the control rod comprises a first control rod, a linking element, and a second control rod; the linking element being arranged between the first control rod and the second control rod and having two ends formed with external threads, respectively; the first control rod and the second control rod at their ends adjacent to the linking element being provided respectively with threaded holes for being coupled with the external threads on the linking element, respectively; the locking block being provided with a fourth through hole for the external threads of the linking element to pass through; the first control rod having its opposite end formed with an external thread while the button having a side thereof for being coupled with the first control rod formed with a threaded hole for mating with the external thread of the first control rod.

14. The collapsible table of claim 10, wherein the control rod comprises a first control rod, a linking element, and a second control rod; the linking element being arranged between the first control rod and the second control rod and having two ends formed with external threads, respectively; the first control rod and the second control rod at their ends adjacent to the linking element being provided respectively with threaded holes for being coupled with the external threads on the linking element, respectively; the locking block being provided with a fourth through hole for the external threads of the linking element to pass through.

15. The collapsible table of claim 10, wherein a bulge is provided at an edge of the raised portion of the second fastening seat, and the first through hole of the rotating piece is peripherally formed with a third notch having a width equal to a joint width of the first notch, the second notch, and an interval between the first notch and the second notch.

16. The collapsible table of claim 10, wherein a positioning block is further protrudingly provided at one side of the second fastening seat adjacent to the corresponding fastening assembly, and the corresponding fastening assembly is provided with a positioning recess corresponding in position to the positioning block.

* * * * *